US009846399B2

(12) United States Patent
Oshima et al.

(10) Patent No.: US 9,846,399 B2
(45) Date of Patent: Dec. 19, 2017

(54) POSITION DETECTION APPARATUS THAT DETECTS POSITION OF TARGET

(71) Applicant: CANON KABUSHIKI KAISHA, Tokyo (JP)

(72) Inventors: Kana Oshima, Ako (JP); Shusuke Miura, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/371,846

(22) Filed: Dec. 7, 2016

(65) Prior Publication Data

US 2017/0168440 A1 Jun. 15, 2017

(30) Foreign Application Priority Data

Dec. 14, 2015 (JP) ..... 2015-242983

(51) Int. Cl.
*G03G 15/00* (2006.01)
*G03G 15/16* (2006.01)

(52) U.S. Cl.
CPC ..... *G03G 15/5054* (2013.01); *G03G 15/1605* (2013.01); *G03G 15/1615* (2013.01); *G03G 2215/00156* (2013.01); *G03G 2215/0129* (2013.01)

(58) Field of Classification Search
CPC ..... G03G 15/1605; G03G 15/1615; G03G 15/5054; G03G 2215/0129; G03G 2215/00156
See application file for complete search history.

(56) References Cited

U.S. PATENT DOCUMENTS 5,347,348 A * 9/1994 Nagata ..... B65G 23/44 198/810.03
7,844,207 B2 * 11/2010 Ryo ..... G03G 15/0131 399/302
8,412,081 B2 4/2013 Kudo et al.
8,874,002 B2 * 10/2014 Nakagawa ..... G03G 15/0189 399/165

* cited by examiner

*Primary Examiner* — Gregory H Curran
(74) *Attorney, Agent, or Firm* — Rossi, Kimms & McDowell LLP

(57) ABSTRACT

A position detection apparatus detects a position of a target in a predetermined direction. One end of a swinging member contacts the target, and the other end contacts a moving member. Sensors are arranged to output signals corresponding to a position of the moving member that corresponds to a position of the moving member. A detection unit detects the position of the target based on the output signals of the sensors. Measured parts are disposed on the moving member along loci of measuring positions of the sensors so that the sum total of the output signals becomes an even number. The detection unit determines that any one of the sensors failed in a case where the sum total of the output signals of the sensors is an odd number.

10 Claims, 9 Drawing Sheets

POSITION DETECTION APPARATUS THAT DETECTS POSITION OF TARGET

BACKGROUND OF THE INVENTION

Field of the Invention

The present invention relates to a position detection apparatus that detects a position of a target.

Description of the Related Art

There is a known image forming apparatus that primarily transfers toner images respectively formed on a plurality of photosensitive members to an intermediate transfer belt and secondarily transfers a color image composited on the intermediate transfer belt to a recording sheet.

Incidentally, when the intermediate transfer belt (a target) in the image forming apparatus is deviated (moves) in a width direction that intersects perpendicularly with a belt conveying direction, color misregistration in which the toner images of the plurality of colors on the intermediate transfer belt are deviated may occur. In order to prevent such color misregistration, a belt-deviation-amount detection technique that detects a deviation amount of the intermediate transfer belt in the width direction that intersects perpendicularly with the belt conveying direction is proposed.

As an apparatus that detects a deviation amount of an intermediate transfer belt, there is a known apparatus that is provided with a swinging arm of which one end is in contact with an edge of the intermediate transfer belt to swing and two transmission optical sensors disposed on the other end of the swinging arm, for example. This deviation amount detection apparatus detects the deviation amount of the belt corresponding to light amount variation due to change in a shield factor with using the fact that the shield factors of the two transmission optical sensors vary corresponding to the swinging angle of the swinging arm (for example, see U.S. Pat. No. 8,412,081).

However, the above-mentioned belt-deviation-amount detection technique cannot detect breakage (hereinafter referred to as failure) even if any one of the optical sensors used for detecting the deviation amount (moving amount) of the belt has broken. Then, if the position of the target is corrected on the basis of the erroneously detected position while one of the sensors fails, an error may occur or the target may break.

SUMMARY OF THE INVENTION

Accordingly, a first aspect of the present invention provides a position detection apparatus that detects a position of a target in a predetermined direction, the position detection apparatus including a swinging member of which one end is in contact with the target in the predetermined direction, a moving member that is in contact with the other end of the swinging member, a plurality of sensors that are arranged in a direction that intersects a moving direction of the moving member and output signals corresponding to a position of the moving member that corresponds to a swinging amount of the swinging member, and a detection unit configured to detect the position of the target based on output signals of the sensors. The moving member has a plurality of measured parts disposed on the moving member along a plurality of loci of measuring positions of the sensors formed on the moving member during movement of the moving member. The measured parts are disposed so that the sum total of the output signals of the sensors becomes an even number. The detection unit determines that any one of the sensors failed in a case where the sum total of the output signals of the sensors is an odd number.

Accordingly, a second aspect of the present invention provides a position detection apparatus that detects a position of a target in a predetermined direction, the position detection apparatus including a swinging member of which one end is in contact with the target in the predetermined direction, a moving member that is in contact with the other end of the swinging member, a plurality of sensors that are arranged in a direction that intersects a moving direction of the moving member and output signals corresponding to a position of the moving member that corresponds to a swinging amount of the swinging member, and a detection unit configured to detect the position of the target based on output signals of the sensors. The moving member has a plurality of measured parts disposed on the moving member along a plurality of loci of measuring positions of the sensors formed on the moving member during movement of the moving member. The measured parts are disposed so that the sum total of the output signals of the sensors becomes an odd number. The detection unit determines that any one of the sensors failed in a case where the sum total of the output signals of the sensors is an even number.

Further features of the present invention will become apparent from the following description of exemplary embodiments with reference to the attached drawings.

DESCRIPTION OF THE EMBODIMENTS

Hereafter, embodiments according to the present invention will be described in detail with reference to the drawings.

Figure 1:
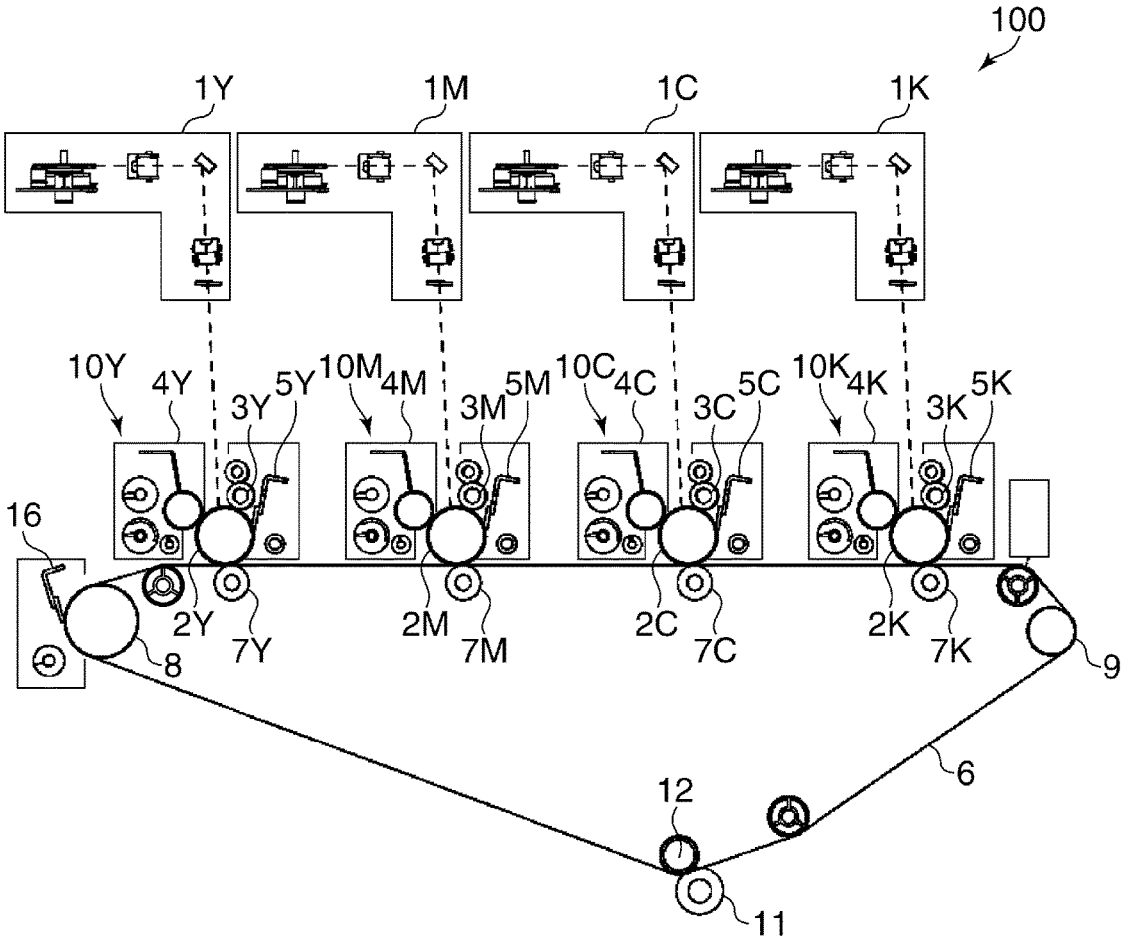
FIG. 1 is a sectional view schematically showing a configuration of an image forming apparatus according to a first embodiment.

FIG. 1 is a sectional view schematically showing a configuration of an image forming apparatus according to a first embodiment. As shown in FIG. 1, the image forming apparatus 100 is provided with an intermediate transfer belt 6 as a target of position detection and a plurality of image forming stations 10Y, 10M, 10C, and 10K that are arranged along a horizontal part of the intermediate transfer belt 6.

The image forming stations 10Y, 10M, 10C, and 10K are respectively provided with photosensitive drums 2Y, 2M, 2C, and 2K as photosensitive members, charging rollers 3Y, 3M, 3C, and 3K that are respectively arranged around the photosensitive drums 2Y, 2M, 2C, and 2K, and laser scanner units 1Y, 1M, 1C, and 1K. Each of the photosensitive drums 2Y, 2M, 2C, and 2K is configured by applying an organic photoconductive layer to a periphery of an aluminum cylinder, and is rotated counterclockwise in FIG. 1 by a driving force transferred from a driving motor (not shown).

The charging rollers 3Y, 3M, 3C, and 3K electrify uniformly the surfaces of the corresponding photosensitive drums 2Y, 2M, 2C, and 2K, respectively. The laser scanner units 1Y, 1M, 1C, and 1K respectively form electrostatic latent images on the surfaces of the corresponding photosensitive drums 2Y, 2M, 2C, and 2K by exposing the photosensitive drums 2Y, 2M, 2C, and 2K selectively on the basis of image data sent from a controller (not shown).

The image forming stations 10Y, 10M, 10C, and 10K are respectively provided with development devices 4Y, 4M, 4C, and 4K, drum cleaners 5Y, 5M, 5C, and 5K, and primary transfer rollers 7Y, 7M, 7C, and 7K that are disposed oppositely to the photosensitive drums through the intermediate transfer belt 6, respectively. The development devices 4Y, 4M, 4C, and 4K are respectively provided with developing sleeves and stirring conveyance members which stir developer, and develop electrostatic latent images by supplying developer to the surfaces of the photosensitive drums 2Y, 2M, 2C, and 2K. The drum cleaners 5Y, 5M, 5C, and 5K respectively collect residual toners on the surface of the photosensitive drums 2Y, 2M, 2C, and 2K after primarily transferring. The collected residual toners are stored in a cleaner container (not shown).

The intermediate transfer belt 6 is an endless belt, and is looped over a plurality of rollers including a driving roller 8, deviation control roller 9, and secondary transfer internal roller 12. The intermediate transfer belt 6 is in slidably contact with the photosensitive drums 2Y, 2M, 2C, and 2K, is rotatably driven in clockwise in FIG. 1, and receives transfer of visible images from the photosensitive drums 2Y, 2M, 2C, and 2K. The visible images transferred to the intermediate transfer belt 6 are superimposed to form a color image.

A secondary transfer external roller 11 is arranged oppositely to the secondary transfer internal roller 12. The contact part of the secondary transfer internal roller 12 and secondary transfer external roller 11 becomes a secondary transfer area. A transfer sheet is conveyed to the secondary transfer area so as to synchronize with the color image famed on the intermediate transfer belt 6 that is rotating, and the color image on the intermediate transfer belt 6 is transferred to the transfer sheet. The secondary transfer external roller 11 is in contact with the intermediate transfer belt 6 while the color image is formed on the intermediate transfer belt 6, and detaches from the intermediate transfer belt 6 after completing the transfer.

A belt cleaner 16 that cleans the intermediate transfer belt 6 is arranged oppositely to the driving roller 8 through the intermediate transfer belt 6. The belt cleaner 16 collects residual toner on the intermediate transfer belt 6 after the secondary transfer. The collected residual toner is stored in a cleaner container (not shown).

Next, an intermediate transfer mechanism of the image forming apparatus in FIG. 1 will be described.

Figure 2:
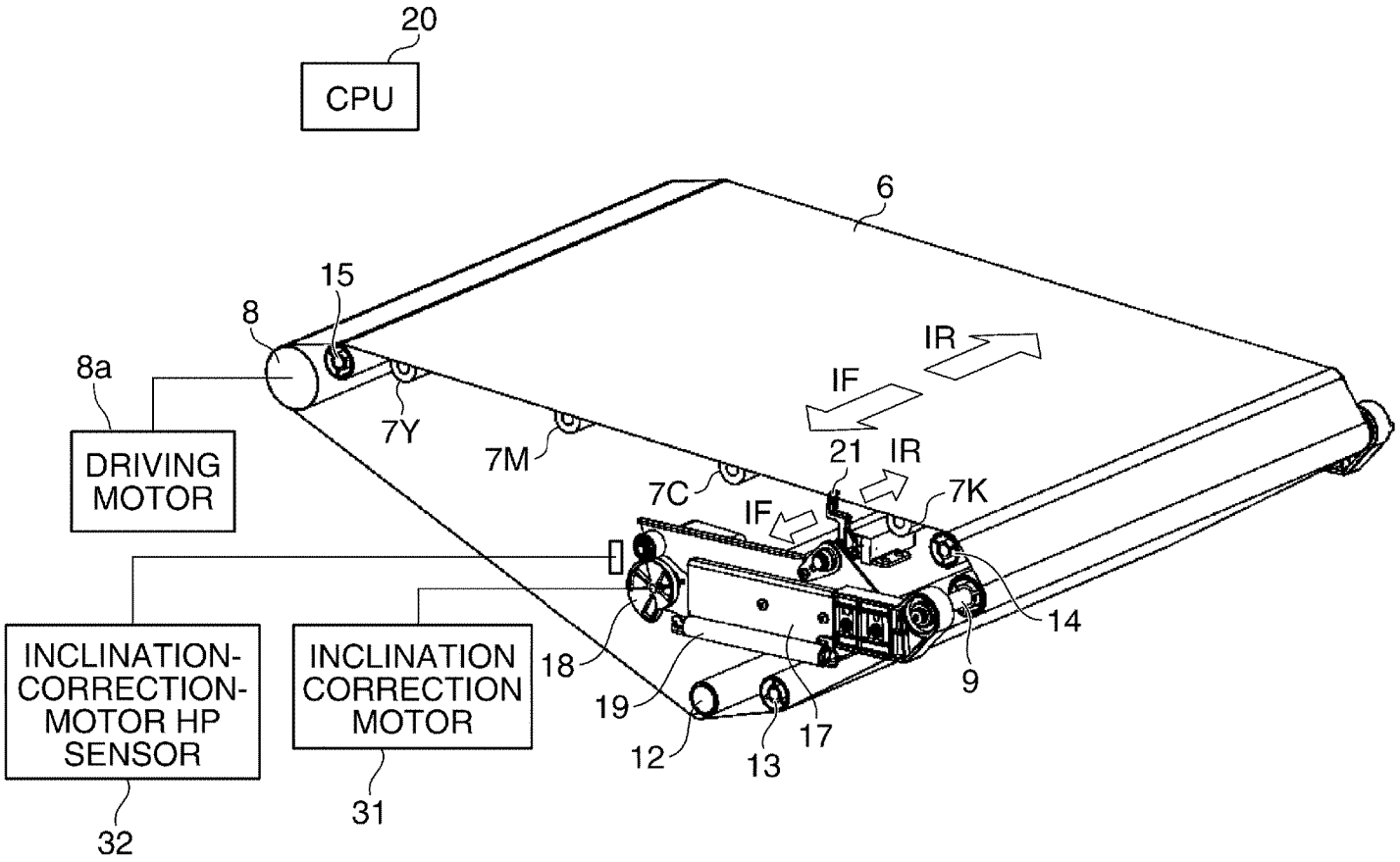
FIG. 2 is a perspective view showing an intermediate transfer mechanism in the image forming apparatus in FIG. 1.

FIG. 2 is a perspective view showing the intermediate transfer mechanism in the image forming apparatus in FIG. 1.

As shown in FIG. 2, the intermediate transfer belt 6 is looped over the driving roller 8, the deviation control roller 9, the secondary transfer internal roller 12, idler rollers 13 through 15, etc. The intermediate transfer belt 6 rotates so as to be in slidably contact with the primary transfer rollers 7Y, 7M, 7C, and 7K of the image forming stations 10Y, 10M, 10C, and 10K corresponding to colors of yellow (Y), magenta (M), cyan (C), and black (K).

The surface of the driving roller 8 is formed by a rubber layer. The driving roller 8 is rotated clockwise by a driving motor 8*a*, and rotates the intermediate transfer belt 6 by the friction between the rubber layer and the internal surface of the intermediate transfer belt 6. Moreover, the driving roller 8 functions as a counter roller of the belt cleaner 16 (FIG. 1), and receives pressure of a cleaning blade.

The deviation control roller 9 corrects deviation of the intermediate transfer belt 6. The far side of the deviation control roller 9 in the longitudinal direction thereof is fixed. Rotation of a deviation correction cam 18 changes inclination of the deviation control roller 9 through a deviation correction arm 17 to correct the deviation of the intermediate transfer belt 6. Moreover, a tension spring 19 (a far side is not shown) pressurizes the deviation control roller 9 in the outside direction of the intermediate transfer belt 6, which stretches the intermediate transfer belt 6.

The secondary transfer internal roller 12 is a counter roller that backs up the secondary transfer external roller 11 at the time of transferring the color image formed on the intermediate transfer belt 6 to the transfer sheet. The idler rollers 13 through 15 are stretching rollers that stretch the intermediate transfer belt 6. Particularly, the idler roller 13 is adjusting the posture of the intermediate transfer belt 6 so that the transfer sheet enters into the secondary transfer area along the intermediate transfer belt 6. Moreover, the idler rollers 14 and 15 are adjusting the posture of the intermediate transfer belt 6 so that the plurality of primarily transferring positions famed at the contact parts between the photosensitive drums 2Y, 2M, 2C, and 2K and the primary transfer rollers 7Y, 7M, 7C, and 7K may be maintained in approximately linear shapes.

The intermediate transfer mechanism has an inclination correction motor 31, an inclination-correction-motor HP sensor 32, and a CPU 20 that controls them. The CPU 20 detects a deviation amount of the intermediate transfer belt 6 (a moving amount of a target) on the basis of detection results of a belt-deviation-amount detection apparatus (a position detection apparatus) mentioned later, and corrects the deviation of the intermediate transfer belt 6 by controlling the inclination correction motor. Moreover, the CPU 20 detects failure of an optical sensor that detects the deviation on the basis of the detection result of the belt-deviation-amount detection apparatus.

Next, the belt-deviation-amount detection apparatus that detects the deviation amount of the intermediate transfer belt in the image forming apparatus 100 will be described.

Figure 3A:
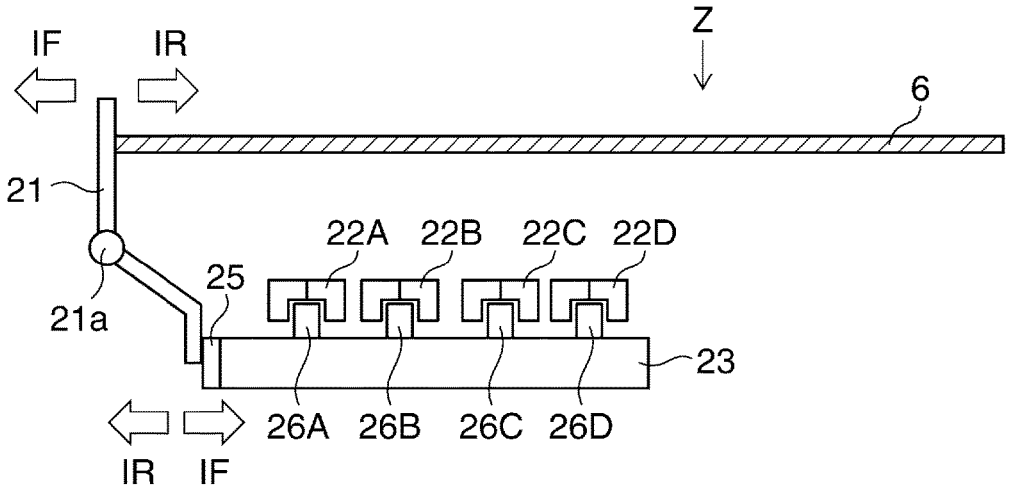
FIG. 3A and FIG. 3B are views schematically showing a configuration of a belt-deviation-amount detection apparatus in the image forming apparatus in FIG. 1.
Figure 3B:
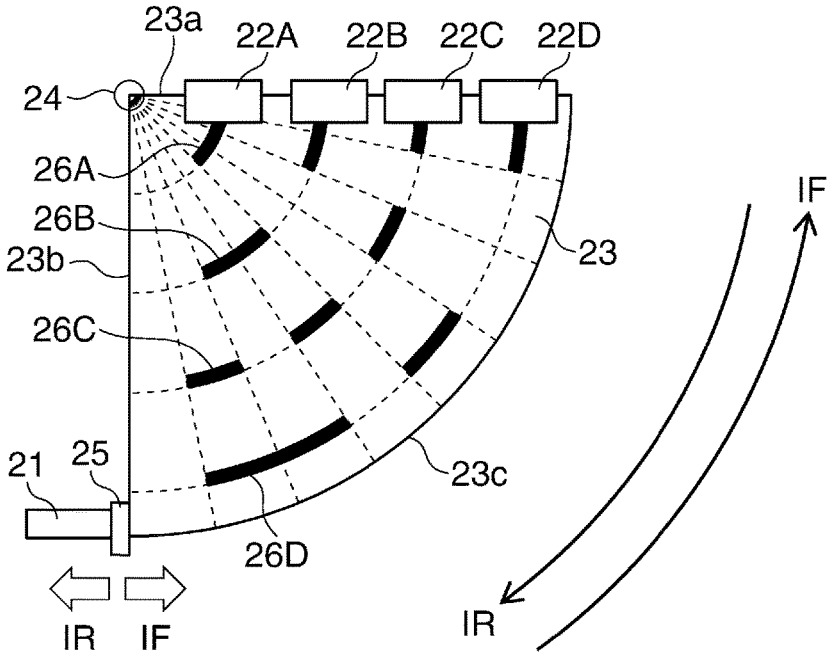

FIG. 3A and FIG. 3B are views schematically showing a configuration of the belt-deviation-amount detection apparatus in the image forming apparatus in FIG. 1. FIG. 3A is a sectional view that is vertical to the belt conveyance direction, and FIG. 3B is a plan view showing a rotating member 23 in FIG. 3A viewed in a direction of an arrow Z. It should be noted that an arrow IF indicates a direction of applied force that occurs when the intermediate transfer belt 6 deviates leftward in FIG. 3A, and an arrow IR indicates a direction of applied force that occurs when the intermediate transfer belt 6 deviates rightward in FIG. 3A.

In FIG. 3A and FIG. 3B, the rotating member 23 as a moving member formed in a fan shape in a plan view is rotatably arranged under the intermediate transfer belt 6. Two sides 23*a* and 23*b* of the rotating member 23 forms 90 degrees, for example. A pivot of the fan shape that is an intersection of the sides 23*a* and 23*b* serves as a rotating shaft 24. A plurality of (N pieces of) optical sensors are arranged over the rotating member 23 in the direction that intersects the rotating direction (moving direction) of the rotating member 23. In this example, four transmission optical sensors 22A, 22B, 22C, and 22D are arranged in the longitudinal direction of the side 23*a*.

A plurality of projection groups 26A, 26B, 26C, and 26D are disposed on the rotating member 23 along a plurality of loci of the transmission optical sensors 22A, 22B, 22C, and 22D that are formed on the rotating member 23 by rotating the rotating member 23 around the rotating shaft 24. It should be noted that the projection group 26A has one projection on the same circumference. Similarly, the projection group 26B has two projections, the projection group 26C has four projections, and the projection group 26D has three projections. The projection groups 26A, 26B, 26C, and 26D disposed on the moving member (the rotating member 23) function as shading member groups to the transmission optical sensors 22A, 22B, 22C, and 22D. It should be noted that the rotating member 23 is made from optically transparent material. Four light sources are disposed under the rotating member 23 so as to be arranged oppositely to the transmission optical sensors 22A, 22B, 22C, and 22D, respectively, through the rotating member 23. The light sources respectively irradiate the transmission optical sensors 22A, 22B, 22C, and 22D with lights that transmit the rotating member 23.

The rotating member 23 of such a configuration is divided into eight rotating areas θ1 through θ8 corresponding to unit arcs that divide a circular arc portion 23*c* into eight equally, for example (see FIG. 4 and FIG. 5A through FIG. 5H mentioned later). The reason why the rotating member 23 is divided into the eight rotating areas θ1 through 88 will be described in detail with reference to FIG. 4 and FIG. 5A through FIG. 5H later.

The projection groups 26A, 26B, 26C, and 26D disposed on the rotating member 23 along the loci of the transmission optical sensors 22A, 22B, 22C, and 22D are arranged so that a combination of output signals of the transmission optical sensors 22A, 22B, 22C, and 22D at the time of reading is different for every rotating area among the rotating areas θ1 through θ8. Arrangement of the projection groups will be described later with reference to FIG. 4.

One end of a swinging arm 21 as a swinging member is in contact with the edge of the intermediate transfer belt 6 in the width direction that intersects perpendicularly with the rotating direction of the intermediate transfer belt 6. The other end across a swinging shaft 21*a* is in contact with a contact surface 25 of the rotating member 23. The contact surface 25 is disposed at a side surface near the circular arc 23*c* of the fan-shaped rotating member 23.

The swinging arm 21 swings around the swinging shaft 21*a* corresponding to the deviation amount of the intermediate transfer belt 6, and the other end that is in contact with the contact surface 25 pushes the contact surface 25 and rotates the rotating member 23 in the direction of the arrow IF, for example. It should be noted that the rotating member 23 is always energized in the direction of the arrow IR by the spring member in FIG. 3B. The combination of the projections of the projection groups 26A, 26B, 26C, and 26D that respectively face the transmission optical sensors 22A, 22B, 22C, and 22D vary corresponding to the rotation angle A of the rotating member 23. As a result of this, the combination of the output signals of the transmission optical sensors 22A, 22B, 22C, and 22D varies.

The transmission optical sensors 22A, 22B, 22C, and 22D shall output an output signal "1", for example, when the projections of the projection groups 26A, 26B, 26C, and 26D as shading member groups shield the incident lights. On the other hand, the transmission optical sensors 22A, 22B, 22C, and 22D shall output an output signal "0", for example, when the projection groups do not shield the incident lights (i.e., when the incident lights are received).

Figure 4:
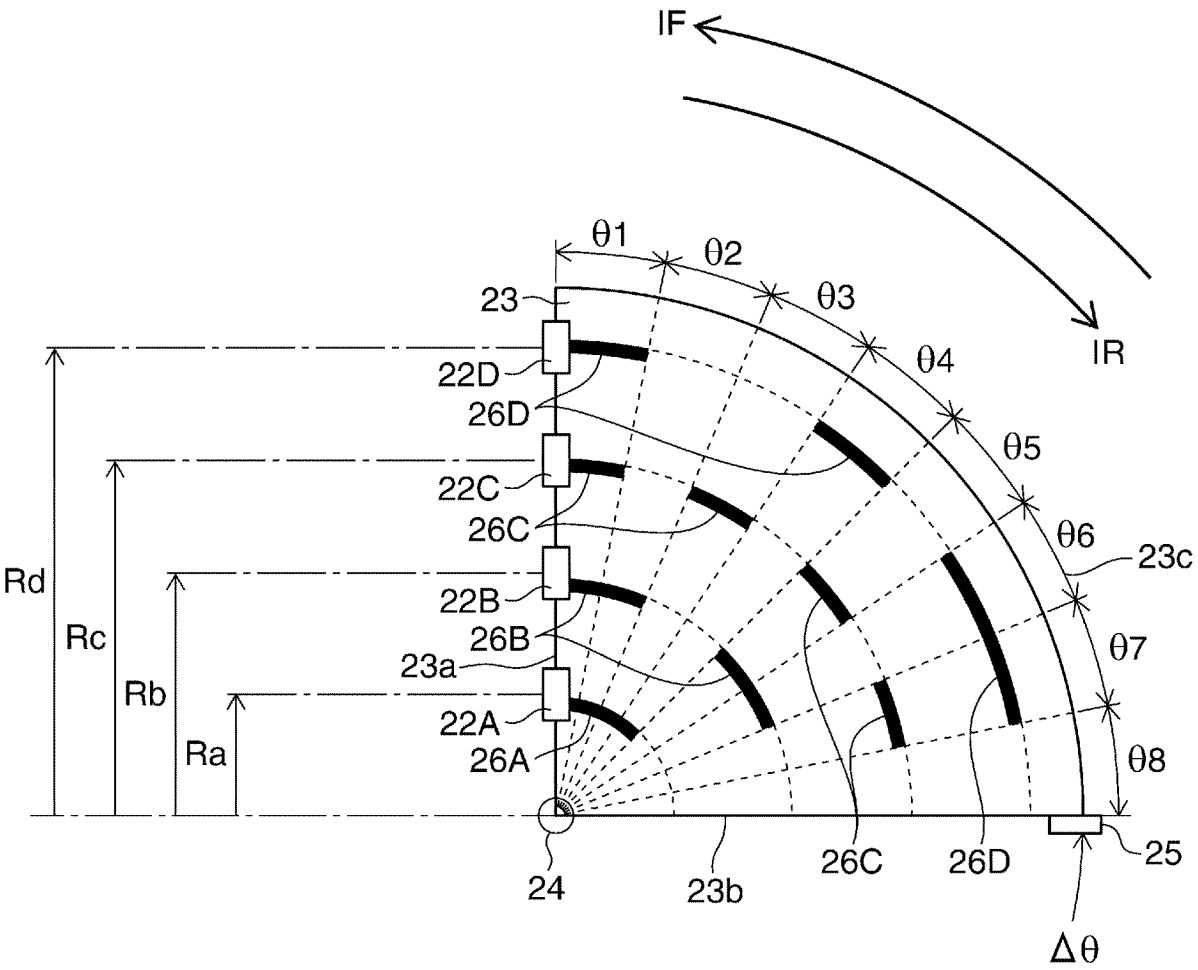
FIG. 4 is a view showing an example of an arrangement of projection groups on a rotating member of the belt-deviation-amount detection apparatus in FIG. 3A and FIG. 3B.

FIG. 4 is a view showing an example of an arrangement of the projection groups 26A, 26B, 26C, and 26D on the rotating member 23.

In FIG. 4, the four transmission optical sensors 22A, 22B, 22C, and 22D are arranged sequentially from the position near the rotating shaft 24 over the rotating member 23 along the side 23*a* in the radius direction of the fan shape. The distance from the rotating shaft 24 to the transmission optical sensors 22A, 22B, 22C, and 22D are Ra, Rb, Rc, and Rd, respectively. The projections of the arc-shaped projection groups 26A, 26B, 26C, and 26D are disposed on the rotating member 23 at the radius positions that respectively correspond to the transmission optical sensors 22A, 22B, 22C, and 22D so that the combination of the projections is different for every rotating area among the rotating areas θ1 through θ8.

The projection of the projection group 26A that corresponds to the transmission optical sensor 22A is formed in the rotating areas θ1 through θ4*a* at the position of the radius Ra from the rotating shaft 24. Moreover, the projections of the projection group 26B that correspond to the transmission optical sensor 22B are formed in the rotating areas θ1, θ2, θ5, and θ6 at the positions of the radius Rb from the rotating shaft 24. Moreover, the projections of the projection group 26C that correspond to the transmission optical sensor 22C are formed in the rotating areas θ1, θ3, θ5, and θ7 at the positions of the radius Rc from the rotating shaft 24. Moreover, the projections of the projection group 26D that correspond to the transmission optical sensor 22D are formed in the rotating areas θ1, θ4, θ6, and θ7 at the positions of the radius Rd from the rotating shaft 24.

The following table 1 shows the output signals of the three transmission optical sensors 22A, 22B, and 22C among the transmission optical sensors 22A, 22B, 22C, and 22D in FIG. 4 for each of the rotating areas θ1 through θ8.

TABLE 1

| | 22A | 22B | 22C |
|---|---|---|---|
| θ1 | 1 | 1 | 1 |
| θ2 | 1 | 1 | 0 |
| θ3 | 1 | 0 | 1 |
| θ4 | 1 | 0 | 0 |
| θ5 | 0 | 1 | 1 |
| θ6 | 0 | 1 | 0 |
| θ7 | 0 | 0 | 1 |
| θ8 | 0 | 0 | 0 |

In the table 1, the combination of the output signals of the transmission optical sensors 22A, 22B, and 22C is different in each of the eight rotating areas θ1 through θ8. Accordingly, it is understood that the projection groups 26A, 26B, and 26C are arranged so that the combination of the output signals of the transmission optical sensors 22A, 22B, and 22C is different for every rotating area.

Moreover, FIG. 5A through FIG. 5H are views showing the rotating positions of the rotating member 23 where the rotating areas θ1 through θ8 face the transmission optical sensors 22A, 22B, 22C, and 22D.

Figure 5A:
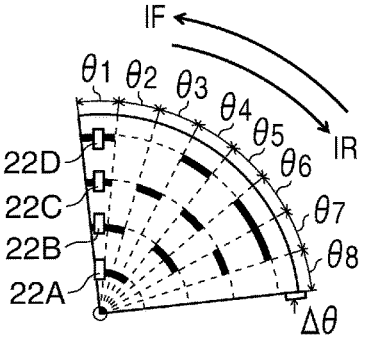
FIG. 5A through FIG. 5H are views showing rotating positions of a rotating member where rotating areas respectively face transmission optical sensors of the belt-deviation-amount detection apparatus in FIG. 3A and FIG. 3B.
Figure 5B:
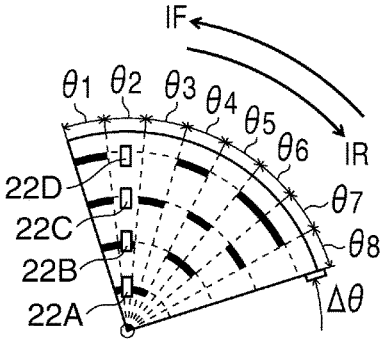
Figure 5C:
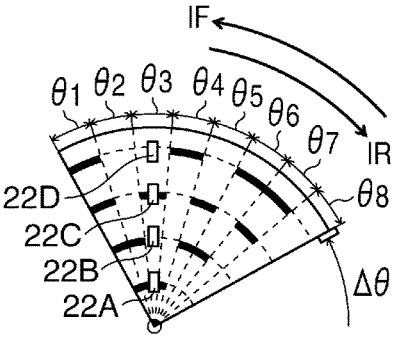
Figure 5D:
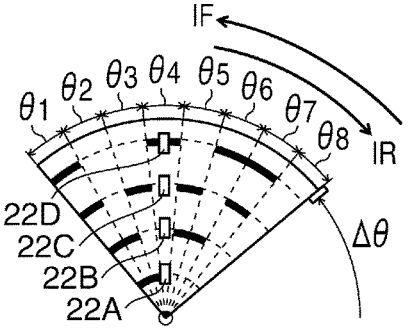
Figure 5E:
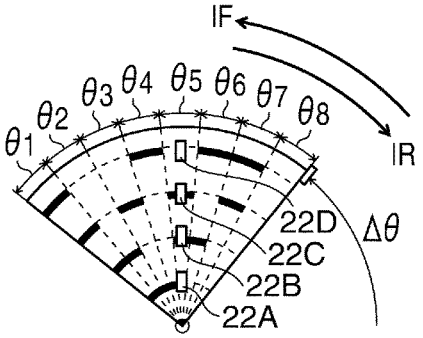
Figure 5F:
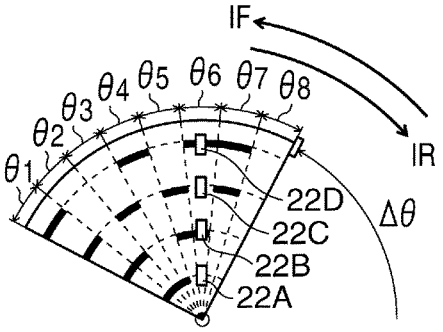
Figure 5G:
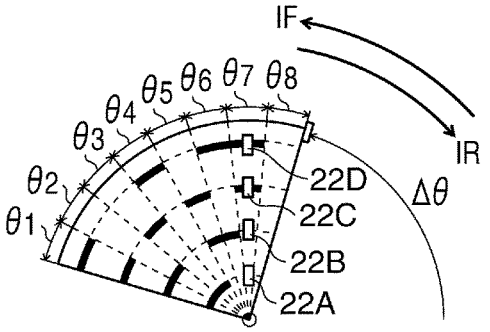
Figure 5H:
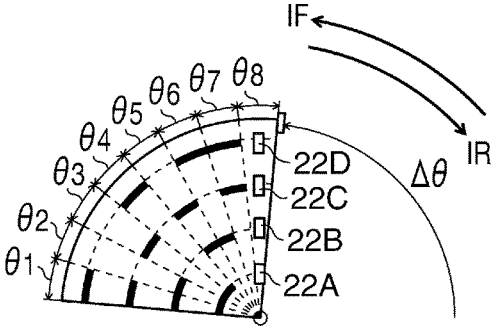

FIG. 5A shows the rotating position of the rotating member 23 where the rotating area θ1 faces the transmission optical sensors 22A, 22B, 22C, and 22D. FIG. 5B shows the rotating position of the rotating member 23 where the rotating area θ2 faces the transmission optical sensors 22A, 22B, 22C, and 22D. Moreover, FIG. 5C shows the rotating position of the rotating member 23 where the rotating area θ3 faces the transmission optical sensors 22A, 22B, 22C, and 22D. FIG. 5D shows the rotating position of the rotating member 23 where the rotating area θ4 faces the transmission optical sensors 22A, 22B, 22C, and 22D. Moreover, FIG. 5E shows the rotating position of the rotating member 23 where the rotating area θ5 faces the transmission optical sensors 22A, 22B, 22C, and 22D. FIG. 5F shows the rotating position of the rotating member 23 where the rotating area θ6 faces the transmission optical sensors 22A, 22B, 22C, and 22D. Furthermore, FIG. 5G shows the rotating position of the rotating member 23 where the rotating area θ7 faces the transmission optical sensors 22A, 22B, 22C, and 22D. FIG. 5H shows the rotating position of the rotating member 23 where the rotating area θ8 faces the transmission optical sensors 22A, 22B, 22C, and 22D.

In the belt-deviation-amount detection apparatus equipped with the rotating member 23 and the transmission optical sensors 22A, 22B, 22C, and 22D of such a configuration, the deviation amount of the intermediate transfer belt 6 is detected with using the combination of the output signals of the transmission optical sensors 22A, 22B, and 22C. Namely, the deviation amount of the intermediate transfer belt 6 is detected with using the combination of the output signals of M types (three types) of the transmission optical sensors corresponding to M types (three types) of the projection groups 26A, 26B, and 26C except one type among N types (four types) of the projection groups in the embodiment.

As shown in FIG. 4 and FIG. 5A through FIG. 5H, the projection of the projection group 26A is disposed in the rotating areas θ1 through 84, the projections of the projection group 26B are disposed in the rotating areas θ1, θ2, θ5, and θ6, and the projections of the projection group 26C are disposed in the rotating areas θ1, θ3, θ5, and θ7.

Hereinafter, the reason why the rotating member 23 is divided into the eight rotating areas θ1 through 88, and the reason why the projection groups 26A, 26B, and 26C are arranged as mentioned above are described.

As mentioned above, the rotating angle Δθ of the rotating member 23 that corresponds to the deviation amount of the intermediate transfer belt 6 is detected with using the three transmission optical sensors 22A, 22B, and 22C among the four transmission optical sensors 22A, 22B, 22C, and 22D in the embodiment.

Accordingly, it is first considered how many combinations the output signals of the three transmission optical sensors 22A, 22B, and 22C give. One sensor is able to output two statuses of ON and OFF. There are three sensors. Accordingly, the output signals of three sensors give eight combinations (i.e., $2^3=8$).

However, if one of the plurality of sensors used for detecting the deviation amount of the intermediate transfer belt 6 fails, the combination of the output signals differs from that shown in the table 1. Accordingly, a correct rotating-angle A of the rotating member 23 is no longer obtained in such a case. In this case, the deviation amount of the intermediate transfer belt 6 is detected erroneously. Then, when an erroneous belt-deviation correction control is performed on the basis of the erroneous detection result, an excessive deviation error may occur or the belt may break.

Consequently, failure of a sensor is detected with using the rotating member 23 and the transmission optical sensors 22A, 22B, 22C, and 22D, which prevents the erroneous belt-deviation correction control on the basis of the erroneous detection result in the embodiment.

Hereinafter, a sensor-failure detection process executed by the CPU 20 in FIG. 2 for detecting failure of a transmission optical sensor will be described.

Figure 6:
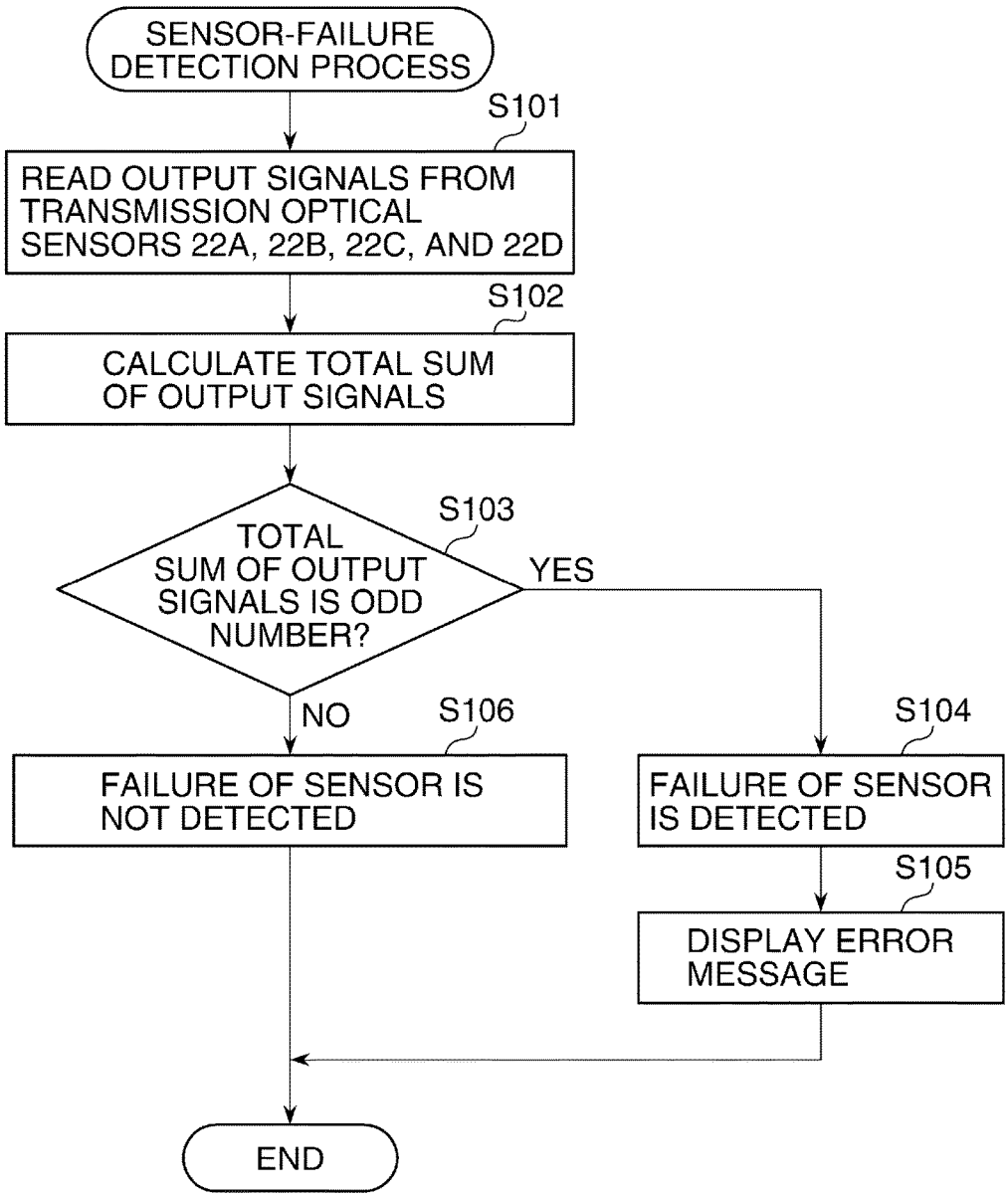
FIG. 6 is a flowchart showing procedures of a sensor-failure detection process executed by the image forming apparatus shown in FIG. 1.

FIG. 6 is a flowchart showing procedures of the sensor-failure detection process executed in the image forming apparatus 100 shown in FIG. 1. The CPU 20 of the image forming apparatus 100 performs the sensor-failure detection process according to a sensor-failure detection program stored in a ROM (not shown). It should be noted that the sensor-failure detection process is performed repeatedly at fixed time intervals during the image forming process.

As shown in FIG. 6, when the sensor-failure detection process is started, the CPU 20 reads the output signals of the four transmission optical sensors 22A, 22B, 22C, and 22D (step S101). Next, the CPU 20 calculates the sum total of the output signals (output values) of the four transmission optical sensors 22A, 22B, 22C, and 22D (step S102). After calculating the sum total of the output signals, the CPU 20 determines whether the calculated sum total of the output signals is an odd number (step S103).

As a result of the determination in the step S103, when the sum total of the output signals is an odd number ("YES" in the step S103), the CPU 20 determines that one of the transmission optical sensors 22A, 22B, 22C, and 22D failed (step S104).

In this embodiment, failure of a sensor is detected with using the projection group 26D and the transmission optical sensor 22D corresponding to the projection group 26D. The projection group 26D is a shading member group other than M types of shading member groups applied to detect the deviation amount of the intermediate transfer belt 6 among the four projection groups 26A, 26B, 26C, and 26D of the rotating member 23.

That is, the projection group 26D is disposed so that the sum total of the output signals of the three transmission optical sensors 22A, 22B, and 22C and the output signal of the transmission optical sensor 22D that faces the projection group 26D becomes an even number, for example. The following table 2 shows examples of the combinations of the output signals of the transmission optical sensors 22A, 22B, 22C, and 22D and the sum totals of the output signals.

TABLE 2

| | 22A | 22B | 22C | 22D | TOTAL OUTPUT |
|---|---|---|---|---|---|
| θ1 | 1 | 1 | 1 | 1 | 4 |
| θ2 | 1 | 1 | 0 | 0 | 2 |
| θ3 | 1 | 0 | 1 | 0 | 2 |

TABLE 2-continued

| | 22A | 22B | 22C | 22D | TOTAL OUTPUT |
|---|---|---|---|---|---|
| θ4 | 1 | 0 | 0 | 1 | 2 |
| θ5 | 0 | 1 | 1 | 0 | 2 |
| θ6 | 0 | 1 | 0 | 1 | 2 |
| θ7 | 0 | 0 | 1 | 1 | 2 |
| θ8 | 0 | 0 | 0 | 0 | 0 |

As shown in the table 2, the combinations of the output signals of the transmission optical sensor 22A, 22B, and 22C corresponding to the rotating areas θ1 through 88 are different mutually, and the sum totals of the output signals of the transmission optical sensors 22A, 22B, 22C, and 22D corresponding to the rotating areas θ1 through 88 are even numbers. In this case, the projections of the projection group 26D are disposed in the rotating areas θ1, θ4, θ6, and θ7 (see FIG. 4 and FIG. 5A through FIG. 5H).

In the belt-deviation-amount detection apparatus constituted thus, when any one of the transmission optical sensors 22A, 22B, 22C, and 22D fails, the sum total of the four sensor output signals may be an odd number. Accordingly, failure of a sensor is detectable by detecting that the sum total of the output signals of the transmission optical sensors becomes an odd number. It should be noted that there is an extremely low possibility that two sensors among a limited plural number of sensors (the four transmission optical sensors 22A, 22B, 22C, and 22D in this case) fail simultaneously. Accordingly, when the sum total of the output signals varies from an even number to an odd number, it is determined that any one of the four transmission optical sensors 22A, 22B, 22C, and 22D failed in the embodiment.

Hereinafter, concrete examples in which one of four transmission optical sensors failed will be described. It should be noted that an output signal shall be always "0" when a transmission optical sensor failed.

The following table 3 shows the combinations of the output signals of the sensors corresponding to the rotating areas when the transmission optical sensor 22B among the transmission optical sensors 22A, 22B, 22C, and 22D failed.

TABLE 3

| | 22A | 22B | 22C | 22D | TOTAL OUTPUT |
|---|---|---|---|---|---|
| θ1 | 1 | 0 | 1 | 1 | 3 (ODD) |
| θ2 | 1 | 0 | 0 | 0 | 1 (ODD) |
| θ3 | 1 | 0 | 1 | 0 | 2 (EVEN) |
| θ4 | 1 | 0 | 0 | 1 | 2 (EVEN) |
| θ5 | 0 | 0 | 1 | 0 | 1 (ODD) |
| θ6 | 0 | 0 | 0 | 1 | 1 (ODD) |
| θ7 | 0 | 0 | 1 | 1 | 2 (EVEN) |
| θ8 | 0 | 0 | 0 | 0 | 0 (EVEN) |

As shown in the table 3, since the transmission optical sensor 22B failed, the output signal of the transmission optical sensor 22B is always "0". In this case, the sum total of the output signals varies from an even number to an odd number in the rotating areas θ1, θ2, θ5 and θ6 as shown in the table 3.

Accordingly, when the rotating member 23 rotates according to the deviation amount of the intermediate transfer belt 6, and when the transmission optical sensors 22A, 22B, 22C, and 22D face the rotating area θ1, θ2, θ5, or θ6, it is determined that any one of the transmission optical sensors failed.

On the other hand, when the sensors face the rotating area θ3, θ4, θ7, or θ8, the combination of the output signals of the transmission optical sensors is not different from that in the normal state because the output signal of the transmission optical sensor 22B is "0" even if it does not fail. In the rotating areas θ3, θ4, θ7, and θ8, since the sum total does not vary from an even number to an odd number, failure of a transmission optical sensor is undetectable. However, the rotating area that faces the sensors is specified on the basis of the combination of the output signals of the transmission optical sensors 22A, 22B, and 22C. Accordingly, even if the transmission optical sensor 22B fails, the rotating angle A of the rotating member 23 is detectable in these rotating areas θ3, θ4, θ7, and θ8.

Moreover, when the transmission optical sensors 22A, 22B, 22C, and 22D face the rotating area θ1, θ2, θ5, or θ6 of the rotating member 23 according to the variation of the deviation amount of the intermediate transfer belt 6, the sum total of the output signals becomes an odd number. Accordingly, failure of a transmission optical sensor is detectable at this point of time.

It should be noted that the rotating areas θ1 and θ3 of which the combinations of the output signals of the transmission optical sensors 22A, 22B, and 22C are identical are distinguished on the basis of whether the sum total of the output signals is an odd number or an even number. The rotating areas θ2 and θ4, the rotating areas θ5 and θ7, the rotating areas θ6 and θ8 are also distinguished in the same manner, respectively. The belt-deviation-amount detection method, which combines the combination of the output signals of the transmission optical sensors 22A, 22B, and 22C and the determination of whether the sum total of the output signals is an odd number or an even number, will be mentioned later with reference to table 4.

Referring back to FIG. 6, after detecting the failure of the transmission optical sensor (step S104), the CPU 20 displays an error message showing that one of the plurality of sensors failed on a display unit (not shown) in step S105, and finishes this process after that.

On the other hand, as a result of the determination in the step S103, when the sum total of the output signals is not an odd number ("NO" in the step S103), the CPU 20 determines that failure of a transmission optical sensor is not detected in step S106, and finishes this process after that.

As mentioned above, the transmission optical sensors 22A, 22B, 22C, and 22D are arranged at the side of the rotating member 23 so that each of the sensors outputs "1" when a projection as a shading part is detected and outputs "0" when a projection is not detected. Moreover, the projections of the projection groups 26A, 26B, 26C, and 26D are disposed so that the combination of the output signals of the sensors differs for each of the rotating areas θ1 through θ8 and so that the sum total of the output signals of the sensors becomes an even number. Then, according to the process in FIG. 6, failure of a sensor is presumed when the sum total of the output signals of the transmission optical sensors 22A, 22B, 22C, and 22D varies from an even number to an odd number. This enables to detect failure of any one sensor among the transmission optical sensors 22A, 22B, 22C, and 22D.

Next, the deviation detection method for the intermediate transfer belt 6 using the sensor-fault detection will be described.

The following table 4 shows the output signals when the transmission optical sensor 22A among the transmission optical sensors 22A, 22B, 22C, and 22D failed.

TABLE 4

| | 22A | 22B | 22C | 22D | TOTAL OUTPUT |
|---|---|---|---|---|---|
| θ1 | 0 | 1 | 1 | 1 | 3 (ODD) |
| θ2 | 0 | 1 | 0 | 0 | 1 (ODD) |
| θ3 | 0 | 0 | 1 | 0 | 1 (ODD) |
| θ4 | 0 | 0 | 0 | 1 | 1 (ODD) |
| θ5 | 0 | 1 | 1 | 0 | 2 (EVEN) |
| θ6 | 0 | 1 | 0 | 1 | 2 (EVEN) |
| θ7 | 0 | 0 | 1 | 1 | 2 (EVEN) |
| θ8 | 0 | 0 | 0 | 0 | 0 (EVEN) |

As shown in Table 4, when the transmission optical sensor 22A failed, the rotating areas θ1 and θ5 cannot be distinguished on the basis of the output signals of the three transmission optical sensors 22A, 22B, and 22C. In the same manner, the rotating area θ2 and θ6, the rotating areas θ3 and θ7, and the rotating areas θ4 and θ8 cannot be distinguished without using the output signal of the transmission optical sensor 22D. Accordingly, even when the transmission optical sensors 22A, 22B, 22C, and 22D actually face the rotating area θ1, it may be erroneously detected that the sensors face the rotating area θ5. In this case, it is determined that the rotating member 23 rotated quickly until the rotating area facing the transmission optical sensors varied from θ1 to θ5 in the IF direction in FIG. 5A, for example. As a result, it is erroneously detected that the intermediate transfer belt 6 was deviated in the IF direction quickly.

Then, the deviation correction control is performed so that the deviation of the intermediate transfer belt 6 is corrected by the deviation control roller 9 in the IR direction that is opposite to the IF direction. However, since the actual deviation amount of the intermediate transfer belt 6 is an amount equivalent to the rotating area θ1, the position of the intermediate transfer belt 6 after the correction will excessively deviate in the IR direction as a result. Moreover, an excessive deviation error may occur due to excessive deviation of the intermediate transfer belt 6, and the intermediate transfer belt 6 may run on an edge member and corrupt.

Consequently, the deviation amount of the intermediate transfer belt 6 is detected with using the sensor-failure detection result in the embodiment. That is, as shown in the table 4, the rotating areas θ1 and θ5 cannot be distinguished on the basis of the output signals of the transmission optical sensors 22A, 22B, and 22C. In the same manner, the rotating area θ2 and θ6, the rotating areas θ3 and θ7, and the rotating areas θ4 and θ8 cannot be distinguished, respectively. However, the sum totals of the output signals in the rotating areas θ1, θ2, θ3, and θ4 are odd numbers, respectively, and the sum totals of the output signals in the rotating areas θ5, θ6, θ7, and θ8 are even numbers, respectively. Accordingly, when the combination of the output signals of the transmission optical sensors 22A, 22B, and 22C and the sum total of the output signals are combined, the rotating areas θ1 and θ5, the rotating area θ2 and θ6, the rotating areas θ3 and θ7, and the rotating areas θ4 and θ8 are able to be distinguished, respectively. This avoids erroneous detection of the rotating angle of the rotating member 23.

According to the embodiment, the rotating angle Δθ of the rotating member 23 is detected without erroneous detection on the basis of the combination of the output signals of the transmission optical sensors 22A, 22B, and 22C and the determination of whether the sum total of the output signals of the transmission optical sensor 22A, 22B, 22C, and 22D is an odd number or an even number. Then, the deviation amount of the intermediate transfer belt 6 is found using the detected rotating angle Δθ of the rotating member 23. Moreover, when the deviation of the intermediate transfer belt 6 is corrected on the basis of the found deviation amount, the erroneous correction control for the intermediate transfer belt 6 on the basis of the erroneous detection is prevented, which avoids an excessive deviation error and corruption of the belt, etc.

Although the deviation amount of the intermediate transfer belt 6 is detected by detecting the rotating angle A of the rotating member 23 from the eight ($=2^3$) rotating areas with using the three transmission optical sensors in the embodiment, the number of the transmission optical sensors is not limited particularly. When the number of the transmission optical sensors is increased and the rotating member 23 is divided into more areas correspondingly, the resolution of the detectable belt deviation amount is improved.

In the embodiment, failure of a sensor is detected when the sum total of the output signals of the four transmission optical sensors 22A, 22B, 22C, and 22D varies from an even number to an odd number. On the other hand, the projection group 26D as the shading member group may be arranged so that the sum total of the output signals of the four transmission optical sensors 22A, 22B, 22C, and 22D becomes an odd number. In such a case, failure of a sensor is detectable when the sum total of the output signals of the four sensors varies from an odd number to an even number.

Next, a second embodiment of the present invention will be described.

Figure 7A:
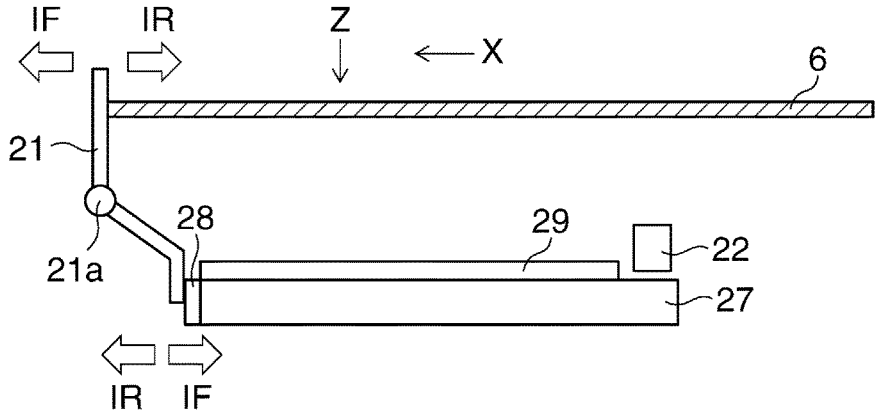
FIG. 7A, FIG. 7B, and FIG. 7C are views schematically showing a configuration of a belt-deviation-amount detection apparatus in a second embodiment.
Figure 7B:
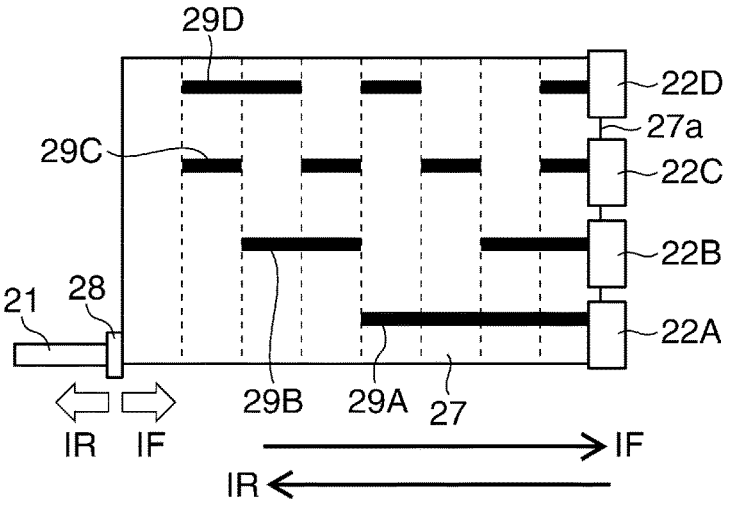
Figure 7C:
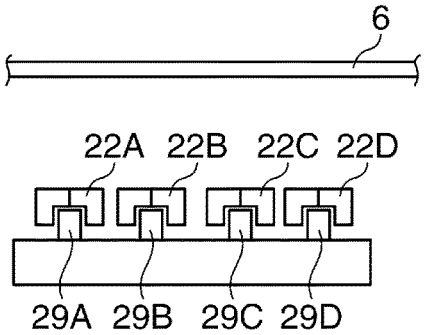

FIG. 7A, FIG. 7B, and FIG. 7C are views schematically showing a configuration of a belt-deviation-amount detection apparatus in a second embodiment. FIG. 7A is a sectional view that is vertical to the belt conveying direction. FIG. 7B is a plan view showing a slide member shown in FIG. 7A viewed in a direction of an arrow Z. FIG. 7C is a side view showing the slide member shown in FIG. 7A viewed in a direction of an arrow X. It should be noted that an arrow IF in FIG. 7A and FIG. 7B indicates a direction of applied force that is generated when the intermediate transfer belt 6 deviates leftward in FIG. 7A, and an arrow IR indicates a direction of applied force that is generated when the intermediate transfer belt 6 deviates rightward in FIG. 7A.

As shown in FIG. 7A, FIG. 7B, and FIG. 7C, a tabular slide member 27, which appears a rectangle in the plan view (FIG. 7B), is arranged under the intermediate transfer belt 6 as a moving member so as to be movable in a predetermined direction, i.e., a longitudinal direction of the rectangle. The four transmission optical sensors 22A, 22B, 22C, and 22D are arranged over a short side 27*a* that intersects perpendicularly with the moving direction of the slide member 27 along the short side 27*a*. The configurations of the transmission optical sensors 22A, 22B, 22C, and 22D are the same as that of the first embodiment mentioned above.

A plurality of projection groups 29A, 29B, 29C, and 29D are disposed on the slide member 27 along a plurality of loci of the transmission optical sensors 22A, 22B, 22C, and 22D that are formed on the slide member 27 by sliding the slide member 23 in the IF direction or the IR direction in FIG. 7A. The projection groups 29A, 29B, 29C, and 29D function as the shading member groups to the transmission optical sensors 22A, 22B, 22C, and 22D. It should be noted that the slide member 27 is made from optically transparent material. Four light sources are disposed under the slide member 27 so as to irradiate the transmission optical sensors 22A, 22B, 22C, and 22D with light, respectively.

Figure 8:
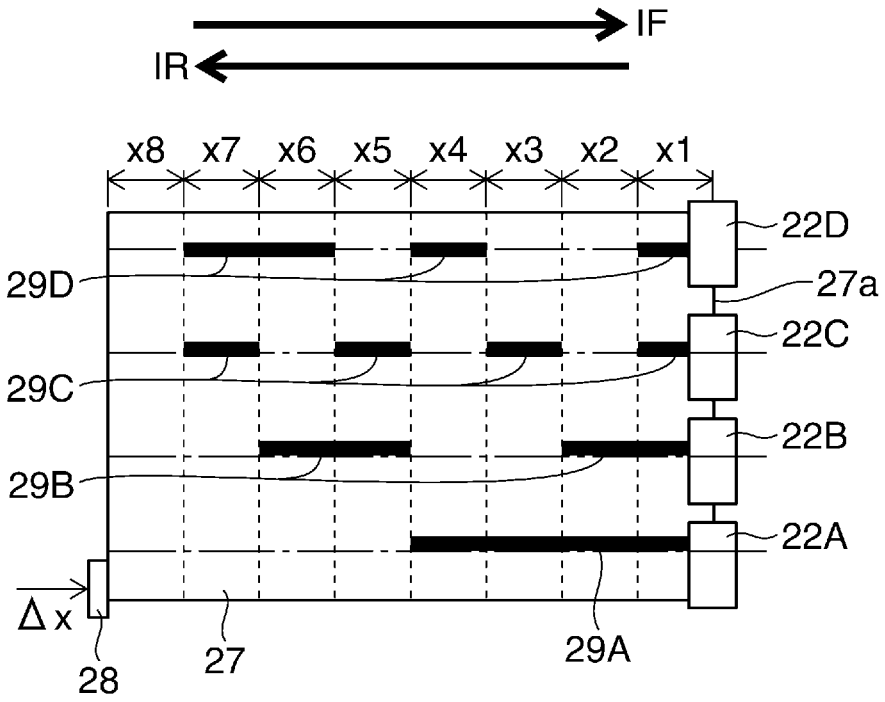
FIG. 8 is a view showing an example of an arrangement of projection groups on a slide member of the belt-deviation-amount detection apparatus in the second embodiment.

The slide member 27 of such a configuration is equally divided into eight slide areas x1 through x8 in the slide direction (moving direction) of the slide member 27, as shown in FIG. 8 mentioned later. The reason why the slide member is divided into the eight slide areas is the same as that of the first embodiment. Accordingly, the description is omitted.

The projection groups 29A, 29B, 29C, and 20D disposed on the slide member 27 along the loci of the transmission optical sensors 22A, 22B, 22C, and 22D are arranged so that a combination of output signals of the transmission optical sensors 22A, 22B, 22C, and 22D at the time of reading is different for every slide area among the slide areas x1 through x8. The arrangements of the projection groups will be described later with reference to FIG. 8.

One end of the swinging arm 21 (a swinging member) is in contact with the edge of the intermediate transfer belt 6 in the width direction that intersects perpendicularly with the rotating direction of the intermediate transfer belt 6. The other end is in contact with a contact surface 28 of the slide member 27. The contact surface 28 is a side surface of the slide member 27.

The swinging arm 21 swings around the swinging shaft 21*a* corresponding to the deviation amount of the intermediate transfer belt 6, and the other end that is in contact with the contact surface 28 pushes the slide member 27 and moves the slide member 27 rightward in FIG. 7B, for example. It should be noted that the slide member 27 is always energized leftward in FIG. 7B by the spring member. The combination of the projections of the projection groups 29A, 29B, 29C, and 29D that face the transmission optical sensors 22A, 22B, 22C, and 22D vary corresponding to the slide amount of the slide member 27. As a result of this, the combination of the output signals of the transmission optical sensors 22A, 22B, 22C, and 22D varies among a plurality of combinations.

The transmission optical sensors 22A, 22B, 22C, and 22D shall output an output signal "1" as a detection result of "ON", for example, when detecting the projection groups 29A, 29B, 29C, and 29D as the shading member groups. On the other hand, the transmission optical sensors 22A, 22B, 22C, and 22D shall output an output signal "0" as a detection result of "OFF", for example, when not detecting the projection groups.

FIG. 8 is a view showing an example of an arrangement of the projection groups 29A, 29B, 29C, and 29D on the slide member 27.

As shown in FIG. 8, the four transmission optical sensors 22A, 22B, 22C, and 22D are arranged sequentially from the position near the contact surface 28 over the slide member 27 along the short side 27*a* that intersects perpendicularly with the slide direction of the side member 27. The projections of the four projection groups 29A, 29B, 29C, and 29D are disposed on the slide member 27 at the positions that respectively correspond to the transmission optical sensors 22A, 22B, 22C, and 22D so that the combination of the projections is different for every slide area among the slide areas x1 through x8.

The projection of the projection group 29A corresponding to the transmission optical sensor 22A is formed in the slide areas x1 through x4. Moreover, the projections of the projection group 29B corresponding to the transmission optical sensor 22B are formed in the slide areas x1, x2, x5, and x6. Moreover, the projections of the projection group 29C corresponding to the transmission optical sensor 22C are formed in the slide areas x1, x3, x5, and x7. Moreover, the projections of the projection group 29D corresponding to the transmission optical sensor 22D are formed in the slide areas x1, x4, x6, and x7.

The following table 5 shows the output signals of the three transmission optical sensors 22A, 22B, and 22C among the transmission optical sensors 22A, 22B, 22C, and 22D in FIG. 8 for each of the slide areas x1 through x8.

TABLE 5

| | 22A | 22B | 22C |
|---|---|---|---|
| x1 | 1 | 1 | 1 |
| x2 | 1 | 1 | 0 |
| x3 | 1 | 0 | 1 |
| x4 | 1 | 0 | 0 |
| x5 | 0 | 1 | 1 |
| x6 | 0 | 1 | 0 |
| x7 | 0 | 0 | 1 |
| x8 | 0 | 0 | 0 |

As shown in the table 5, the combination of the output signals of the transmission optical sensors 22A, 22B, and 22C is different in each of the eight slide areas x1 through x8. Accordingly, it is understood that the projection groups 29A, 29B, and 29C are arranged so that the combination of the output signals of the transmission optical sensors 22A, 22B, and 22C is different for every slide area.

FIG. 9A through FIG. 9H are views showing slide positions of the slide member 27 where the slide areas x1 through x8 respectively face the transmission optical sensors 22A, 22B, 22C, and 22D.

Figure 9A:
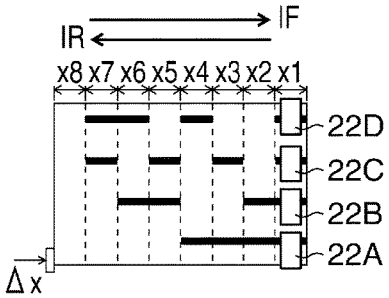
FIG. 9A through FIG. 9H are views showing slide positions of the slide member where slide areas respectively face transmission optical sensors of the belt-deviation-amount detection apparatus in the second embodiment.
Figure 9B:
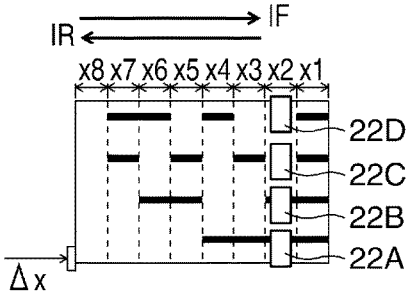
Figure 9C:
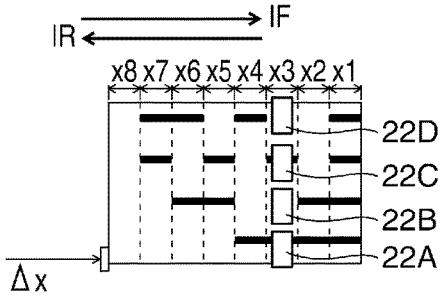
Figure 9D:
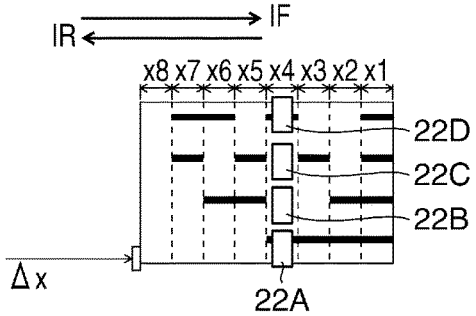
Figure 9E:
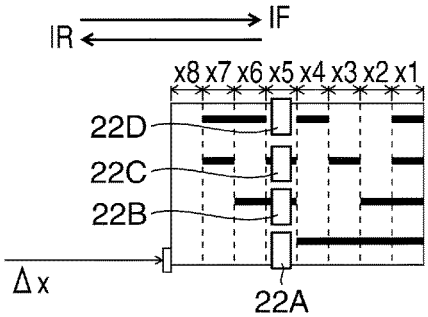
Figure 9F:
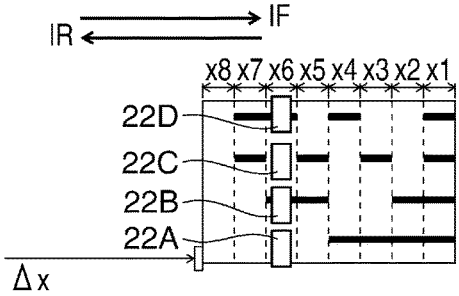
Figure 9G:
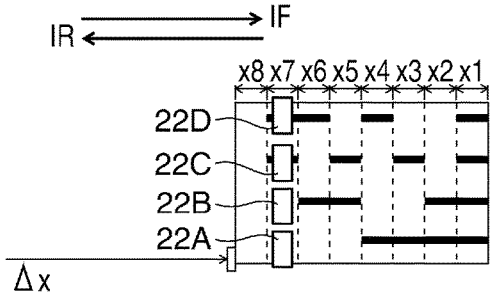
Figure 9H:
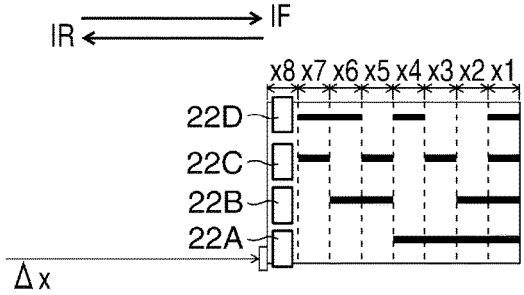

FIG. 9A shows the slide position of the slide member 27 where the slide area x1 faces the transmission optical sensors 22A, 22B, 22C, and 22D. FIG. 9B shows the slide position of the slide member 27 where the slide area x2 faces the transmission optical sensors 22A, 22B, 22C, and 22D. Moreover, FIG. 9C shows the slide position of the slide member 27 where the slide area x3 faces the transmission optical sensors 22A, 22B, 22C, and 22D. FIG. 9D shows the slide position of the slide member 27 where the slide area x4 faces the transmission optical sensors 22A, 22B, 22C, and 22D. Moreover, FIG. 9E shows the slide position of the slide member 27 where the slide area x5 faces the transmission optical sensors 22A, 22B, 22C, and 22D. FIG. 9F shows the slide position of the slide member 27 where the slide area x6 faces the transmission optical sensors 22A, 22B, 22C, and 22D. Furthermore, FIG. 9G shows the slide position of the slide member 27 where the slide area x7 faces the transmission optical sensors 22A, 22B, 22C, and 22D. FIG. 9H shows the slide position of the slide member 27 where the slide area x8 faces the transmission optical sensors 22A, 22B, 22C, and 22D.

As shown in FIG. 8 and FIG. 9A through FIG. 9H, the projection of the group 26A is disposed in the slide areas x1 through x4, the projections of the projection group 26B are disposed in the slide areas x1, x2, x5, and x6, and the projections of the projection group 29C are disposed in the slide areas x1, x3, x5, and x7.

In the belt-deviation-amount detection apparatus of such a configuration, the deviation amount of the intermediate transfer belt 6 is detected on the basis of the combination of the output signals of the transmission optical sensors 22A, 22B, and 22C. That is, the slide amount of the slide member 27 is detected by using the fact that the combination of the output signals of the transmission optical sensors 22A, 22B, and 22C differs for each of the eight slide areas of the slide member 27. Then, the deviation amount of the intermediate transfer belt 6 is detected on the basis of the slide amount of the slide member 27.

However, if one of the plurality of sensors used for detecting the deviation amount of the intermediate transfer belt fails, the combination of the output signals differs from that shown in the table 5. Accordingly, correct moving amount Δx of the slide member 27 will be no longer obtained, and the deviation amount of the intermediate transfer belt 6 will be erroneously detected. Then, when an erroneous belt-deviation correction control is performed on the basis of the erroneous detection result, an excessive deviation error may occur or the belt may break.

Consequently, failure of a sensor is detected with using the slide member 27 and the transmission optical sensors, which prevents the erroneous belt-deviation correction control on the basis of the erroneous detection result in the embodiment.

In this embodiment, failure of a sensor is detected with using the projection group 29D and the transmission optical sensor 22D corresponding to the projection group 29D. The projection group 29D is not applied to detect the deviation amount of the intermediate transfer belt 6 among the four projection groups 26A, 26B, 26C, and 26D of the rotating member 27. In this example, the projections of the projection group 29D are disposed in the slide areas x1, x4, x6, and x7 (see FIG. 8).

In this embodiments, the projection group 26D is arranged so that the sum total of the output signals of the three transmission optical sensors 22A, 22B, and 22C and the output signal of the transmission optical sensor 22D that faces the projection group 26D becomes an even number, for example. The following table 6 shows examples of the combinations of the output signals of the transmission optical sensors 22A, 22B, 22C, and 22D and the sum totals of the output signals.

TABLE 6

| | 22A | 22B | 22C | 22D | TOTAL OUTPUT |
|---|---|---|---|---|---|
| x1 | 1 | 1 | 1 | 1 | 4 |
| x2 | 1 | 1 | 0 | 0 | 2 |
| x3 | 1 | 0 | 1 | 0 | 2 |
| x4 | 1 | 0 | 0 | 1 | 2 |
| x5 | 0 | 1 | 1 | 0 | 2 |
| x6 | 0 | 1 | 0 | 1 | 2 |
| x7 | 0 | 0 | 1 | 1 | 2 |
| x8 | 0 | 0 | 0 | 0 | 0 |

As shown in the table 6, the combinations of the output signals of the transmission optical sensor 22A, 22B, and 22C corresponding to the side areas x1 through x8 are different mutually, and the sum totals of the output signals of the transmission optical sensors 22A, 22B, 22C, and 22D corresponding to the slide areas x1 through x8 are even numbers.

In the belt-deviation-amount detection apparatus of such a configuration, when any one of the transmission optical sensors 22A, 22B, 22C, and 22D fails, the sum total of the four sensor output signals may be an odd number. Accordingly, failure of a sensor is detectable by detecting that the sum total of the output signals of the transmission optical sensors becomes an odd number.

The procedure of the sensor-failure detection process is the same as that of the flowchart in FIG. 6 mentioned above. Accordingly, the description is omitted. Moreover, the detection method for the deviation amount of the intermediate transfer belt 6 with using the sensor-failure detection result is also performed in the same manner as the first embodiment mentioned above.

In the second embodiment, the combination of the projections as shading parts of the projection groups 29A, 29B, and 29C varies for each of the slide areas x1 through x8, the combination is detected by the plurality of transmission optical sensors 22A, 22B, and 22C, and the moving amount Δx of the slide member 27 is detected on the basis of the combination of the output signals. Moreover, the projection group 29D is constituted so that the sum total of the output signals of the transmission optical sensor 22A, 22B, 22C, and 22D becomes an even number. When the sum total of the output signals becomes an odd number, failure of a transmission optical sensor is detected. Then, the erroneous detection of the moving amount Δx of the slide member 27 that corresponds to the deviation amount of the intermediate transfer belt 6 is avoided by combining the combination of the output signals of the transmission optical sensors 22A, 22B, and 22C and the sum total of the output signals. Moreover, since this prevents the erroneous belt-deviation correction control on the basis of the erroneous detection result, the deviation is corrected satisfactorily without causing an excessive deviation error, breakage of the belt, etc.

In the embodiment, when the number of the transmission optical sensors is increased and the slide member 27 is divided into more slide areas correspondingly, the resolution of the detectable deviation amount of the intermediate transfer belt 6 is improved. Moreover, failure of a sensor may be detected when the sum total of the output signals of the four transmission optical sensors 22A, 22B, 22C, and 22D varies from an odd number to an even number.

OTHER EMBODIMENTS

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2015-242983, filed Dec. 14, 2015, which is hereby incorporated by reference herein in its entirety.

What is claimed is:

1. A position detection apparatus that detects a position of a target in a predetermined direction, the position detection apparatus comprising:

a swinging member of which one end is in contact with the target in the predetermined direction;

a moving member that is in contact with the other end of said swinging member;

a plurality of sensors that are arranged in a direction that intersects a moving direction of said moving member and output signals corresponding to a position of said moving member that corresponds to a swinging amount of said swinging member; and a detection unit configured to detect the position of the target based on output signals of said sensors, wherein said moving member has a plurality of measured parts disposed on said moving member along a plurality of loci of measuring positions of said sensors formed on said moving member during movement of said moving member, wherein the measured parts are disposed so that the sum total of the output signals of said sensors becomes an even number, and wherein said detection unit determines that any one of said sensors failed in a case where the sum total of the output signals of said sensors is an odd number.

2. The position detection apparatus according to claim 1, wherein said moving member is a fan-shaped rotating member, and the measured parts are disposed on circular arcs of different radii around a rotating shaft of the rotating member.

3. The position detection apparatus according to claim 2, wherein the other end of said swinging member is in contact with a side surface of a circular arc portion of said rotating member, and rotates the rotating member around a pivot of a fan shape by pushing the side surface corresponding to the moving amount of the target.

4. The position detection apparatus according to claim 1, wherein said moving member is a tabular slide member.

5. The position detection apparatus according to claim 4, wherein the other end of said swinging member is in contact with a side surface of the tabular slide member, and moves the tabular slide member in a predetermined direction by pushing the side surface corresponding to the moving amount of the target.

6. A position detection apparatus that detects a position of a target in a predetermined direction, the position detection apparatus comprising:

a swinging member of which one end is in contact with the target in the predetermined direction;

a moving member that is in contact with the other end of said swinging member;

a plurality of sensors that are arranged in a direction that intersects a moving direction of said moving member and output signals corresponding to a position of said moving member that corresponds to a swinging amount of said swinging member; and a detection unit configured to detect the position of the target based on output signals of said sensors, wherein said moving member has a plurality of measured parts disposed on said moving member along a plurality of loci of measuring positions of said sensors formed on said moving member during movement of said moving member, wherein the measured parts are disposed so that the sum total of the output signals of said sensors becomes an odd number, and wherein said detection unit determines that any one of said sensors failed in a case where the sum total of the output signals of said sensors is an even number.

7. The position detection apparatus according to claim 6, wherein said moving member is a fan-shaped rotating member, and the measured parts are disposed on circular arcs of different radii around a rotating shaft of the rotating member.

8. The position detection apparatus according to claim 7, wherein the other end of said swinging member is in contact with a side surface of a circular arc portion of said rotating member, and rotates the rotating member around a pivot of a fan shape by pushing the side surface corresponding to the moving amount of the target.

9. The position detection apparatus according to claim 6, wherein said moving member is a tabular slide member.

10. The position detection apparatus according to claim 9, wherein the other end of said swinging member is in contact with a side surface of the tabular slide member, and moves the tabular slide member in a predetermined direction by pushing the side surface corresponding to the moving amount of the target.

* * * * *